US007090035B2

(12) United States Patent
Lesko

(10) Patent No.: US 7,090,035 B2
(45) Date of Patent: Aug. 15, 2006

(54) METHOD AND SYSTEM FOR CONNECTING PIPE TO A TOP DRIVE MOTOR

(76) Inventor: Gerald Lesko, 4807-68 Avenue, Edmonton, Alberta (CA) T6N 2N2

( * ) Notice: Subject to any disclaimer, the term of this patent is extended or adjusted under 35 U.S.C. 154(b) by 244 days.

(21) Appl. No.: 10/775,028

(22) Filed: Feb. 9, 2004

(65) Prior Publication Data

US 2005/0173154 A1 Aug. 11, 2005

(51) Int. Cl.
*E21B 3/02* (2006.01)

(52) U.S. Cl. ..... 175/57; 175/113

(58) Field of Classification Search ..... 166/377–381, 166/77.1, 77.51–77.53, 85.1; 175/122, 162, 175/170, 195, 202–205
See application file for complete search history.

(56) References Cited

U.S. PATENT DOCUMENTS

| | | | | |
|---|---|---|---|---|
| 2,539,751 | A | 1/1951 | Olsen | |
| 2,589,181 | A | 3/1952 | Yount | |
| 2,743,823 | A | 5/1956 | Breedlove | |
| 3,613,905 | A | 10/1971 | Woolslayer et al. | |
| 3,655,071 | A | 4/1972 | Langowski et al. | |
| 3,734,208 | A | 5/1973 | Otto | |
| 3,785,506 | A | 1/1974 | Crocker et al. | |
| 3,860,122 | A | 1/1975 | Cernosek | |
| 4,274,778 | A | 6/1981 | Putnam et al. | |
| 4,397,605 | A | 8/1983 | Cowgill et al. | |
| 4,403,897 | A | 9/1983 | Willis | |
| 4,403,898 | A | 9/1983 | Thompson | |
| 4,489,794 | A * | 12/1984 | Boyadjieff | 175/85 |
| 4,547,110 | A | 10/1985 | Davidson | |
| 4,582,146 | A | 4/1986 | Becker | |
| 4,610,315 | A | 9/1986 | Koga et al. | |
| 4,822,230 | A | 4/1989 | Slettedal | |
| 4,834,604 | A | 5/1989 | Brittain et al. | |
| 5,107,940 | A * | 4/1992 | Berry | 175/85 |
| 5,127,790 | A | 7/1992 | Teague | |
| 5,458,454 | A | 10/1995 | Sorokan | |
| 5,609,457 | A | 3/1997 | Burns | |
| 6,343,892 | B1 | 2/2002 | Kristiansen | |
| 6,533,519 | B1 | 3/2003 | Tolmon et al. | |
| 6,679,333 | B1 * | 1/2004 | York et al. | 166/379 |

FOREIGN PATENT DOCUMENTS

| | | |
|---|---|---|
| CA | 1204428 | 5/1986 |
| CA | 1232601 | 2/1988 |
| CA | 1279883 | 2/1991 |

* cited by examiner

*Primary Examiner*—Frank Tsay
(74) *Attorney, Agent, or Firm*—Dennis T. Griggs

(57) ABSTRACT

Method and system for connecting a joint of pipe to a top drive motor just above the drilling platform of a drilling rig where the connection can be made quickly and safely by a drilling operator. The system includes a top drive motor that tilts about a horizontal axis and a pipe launcher that brings joints of pipe up to the drilling platform for connection with a top drive motor at a safe and convenient height above the platform. The top drive motor further includes a clamping assembly that grasps and pulls the joint of pipe to the motor as the connection is being made. The clamp assembly supports the motor-pipe connection as the top-drive motor is raised in the drilling mast of the rig bringing the joint of pipe up into a vertical orientation for connection with the drill tubing string.

11 Claims, 18 Drawing Sheets

METHOD AND SYSTEM FOR CONNECTING PIPE TO A TOP DRIVE MOTOR

BACKGROUND OF THE INVENTION

1. Field of the Invention

This invention is related generally to drilling rigs that utilize top drive motors, and in particular to a method and system for connecting drill pipe to top drive motors.

2. Description of the Prior Art

In the oil and gas industry, it is known to use top drive motors to drill wells. Top drive motors are mounted in the drilling mast of the rig and are typically raised lowered in the mast by a draw works mechanism. The top drive motors comprise powerful electrical or hydraulic motors and provide the motive force to rotate the drill string.

A major obstacle with top drive motors is the manner in which joints of pipe are brought up from a storage rack to the drilling platform and connected to the top drive motor and the drill string. Typically, joints of pipe are stored horizontally at ground level and are brought into a vertical position above the drilling platform by a variety of mechanisms. These mechanisms bring the pipe into position above the platform to connect to the top drive motor and to the drill string. These mechanisms may include separate devices that grasp stored pipe and haul it into position above the drilling platform or may include attachments to the top drive motor itself that pull the pipe up above the drilling platform as the top drive motor is raised in the drilling mast. In either of these cases, the pipe is connected to the top drive motor while the top drive assembly is positioned high up in the drilling mast. This height is in excess of 30 to 45 feet above the drilling platform or more depending on the length of each joint of pipe and whether the joints of pipe are assembled as doubles or trebles.

In this situation, it is difficult for a drilling operator located on the drilling platform to quickly and safely connect the joint of pipe to the top drive motor given that the connection is made so high above the platform in the drilling mast.

It is, therefore, desirable to have a method and system of connecting a joint of pipe to a top drive motor at the drilling platform level where a drilling operator can quickly and safely make the connection.

BRIEF SUMMARY OF THE INVENTION

The present invention is concerned with a method and system for connecting a joint of pipe to a top drive motor just above the drilling platform of the drilling rig where the connection can be made quickly and safely by a drilling operator. The key to the present invention is having a top drive assembly that includes a top drive frame with a top drive motor that is pivotally mounted in the top drive frame such that the top drive motor may rotate or tilt about a horizontal axis within the top drive frame. Also essential to the invention is a pipe launcher that brings joints of pipes into position above the drilling platform for connection with the top drive motor.

The method of the present invention comprises positioning the top drive assembly to a predetermined position in the drilling mast at a suitable height above the platform for the top drive motor to be quickly and safely connected to a joint of pipe. At the same time, a joint of pipe is drawn from the pipe storage rack or "pipe tub" located adjacent to the drilling rig by a pipe launcher. The pipe launcher suitably positions the joint of pipe adjacent to the platform so that it may be advanced upwardly at a predetermined angle toward the drilling platform, box end first. The pipe launcher positions the pipe so that it aligns the pipe with the top drive assembly and then pushes the pipe, box end first, toward the top drive motor. The top drive motor is rotated or tilted within the top drive frame from a nominally vertical orientation until the quill of the top drive motor is pointed toward the box end and coaxially aligned with the longitudinal axis of the joint of pipe sitting on the pipe launcher. The pipe is advanced by the pipe launcher toward the top drive motor until the box end of the pipe engages the quill. The quill is then rotated while the pipe is simultaneously advanced toward the top drive motor so that the quill threadably engages the box end of the pipe until the connection is substantially complete.

The top drive assembly is then raised in the mast to raise the joint of pipe above the platform. As the top drive assembly is being raised, the top drive motor gradually turns within the top drive frame back to its nominal vertical orientation, pulling up the joint of pipe along with it. Once the pipe is raised enough to clear the pipe launcher, the pipe and top drive motor are swung back to a vertical orientation such that the pipe is above the drilling platform and the pin end of the pipe is located at a normal working height above the platform. In this position, the pin end of the pipe may receive a drill bit or be connected to the drill string already secured in the drilling platform. This method is performed in reverse when tripping the joint of pipe from the drill string.

The system of the present invention comprises two major elements. The first is the top drive assembly and the second is the pipe launcher. The top drive assembly comprises a top drive frame which is adapted to be raised and lowered in a drilling mast of a drilling rig, the frame having a plurality of rollers on each side of the frame that travel in guide tracks running up the mast on each side of the frame to guide and support the top drive assembly.

The top drive assembly further comprises a top drive motor pivotally attached to the frame such that the top drive motor may rotate or tilt about a substantially horizontal axis that extends between the two guide tracks. The top drive motor may be an electric or hydraulic motor as well known to those skilled in the art. A tilting mechanism is connected to both the frame and the motor. Typically, this mechanism is a hydraulic cylinder, preferably two, each with one end attached to the frame and the other end attached to the motor. When the cylinder is extended or contracted, the motor rotates in the frame about the horizontal axis extending between the pivot points of the frame. The cylinders also hold the motor in position when the motor is used in drilling operations or to receive a joint of pipe. The tilting mechanism may also be a gear mechanism operated by a separate motor.

The top drive motor further comprises a sliding member that has one end slidably attached to the body of the motor with the other end having a pipe clamp subassembly comprising a pair of opposed pipe clamps and their associated actuators. The sliding member travels along an axis that is parallel to the longitudinal axis of the quill of the motor. The sliding member and pipe clamps are used to grasp the box end of a joint of pipe from the pipe launcher and to pull the box end of the pipe toward the quill so that the connection can be made. The sliding member and pipe clamp subassembly support the quill-pipe connection while the top drive assembly is being raised in the mast and when the pipe is finally swung into a vertical position above the platform.

The pipe launcher consists of a frame and a ramp that are pivotally attached to the frame such that one end of the ramp can tilt upwards. Preferably, a hydraulic cylinder is used to tilt the ramp. The frame is positioned beside the rig such that the ramp is pointed toward the platform and is substantially perpendicular to the horizontal pivot axis of the drive motor. The pipe launcher is adapted to receive a joint of pipe from the pipe tub. The pipe is loaded onto the ramp such that the box end of the pipe is at the end of the ramp which is raised upon operation of its hydraulic cylinder. The pin end of the pipe is supported by a buggy that is slidably attached to the ramp. The buggy is used to push the pipe up the ramp so that the box end of the pipe may be connected to the quill top drive motor. The buggy further comprises a rubber insert used to support the pin end of the pipe as the pipe is pushed up the ramp and to protect the threads of the pin end. The buggy also supports the pin end of the pipe as the pipe is raised by the top drive assembly after the connection is made until the pin end is lifted free of the buggy and the pipe can be swung to its vertical position above the platform.

When pipe is tripped out from the drill string, the buggy receives the pin end of the pipe as a joint of pipe is swung from the mast by the top drive motor as the top drive assembly is lowered. The pin end sits in the buggy as it descends down the ramp as the top drive assembly is lowered in the mast. In doing so, the top drive motor rotates in the top drive frame to prevent the pipe from bending. Once the pipe is lowered and laying flat on the ramp, the pipe clamps hold the box end while the quill is rotated to disengage the connection with the pipe. After being disengaged from the quill, the pipe continues to descend down the ramp until it has cleared the drilling platform. The pipe launcher then lowers the pipe to be stored in the pipe tub.

An important aspect of the present invention is a method for connecting a joint of pipe to a top drive assembly located in a drilling mast of a drilling rig, the method comprising the steps of raising or lowering the top drive assembly in the drilling mast to a first predetermined position above a drilling platform on the drilling rig, the top drive assembly having a top drive motor with a rotatable quill, said first predetermined position suitable for the top drive assembly to connect with a joint of pipe, the joint of pipe having a box end and a pin end defining a longitudinal axis between said ends; moving a joint of pipe to a second predetermined position adjacent to the drilling platform suitable for connecting the joint of pipe to the top drive assembly, the joint of pipe having the box end pointed toward the top drive assembly; tilting the top drive motor about a substantially horizontal axis until the quill is pointed toward the box end of said pipe and substantially aligned coaxially with the longitudinal axis of said pipe; pushing the joint of pipe along its longitudinal axis from the second predetermined position toward the top drive motor whereby the box end of the pipe may be threadably engaged to the quill; and grasping and pulling the joint of pipe along its longitudinal axis toward the top drive motor while simultaneously rotating the quill to threadably engage the box end of the pipe until the connection between the joint of pipe and the top drive assembly is substantially complete.

Another aspect of the present invention is a system for connecting a joint of pipe to a top drive assembly located in a drilling mast of a drilling rig, the drilling mast defining a substantially vertical drilling axis, the system comprising a top drive assembly having a top drive motor with a quill capable of rotation about an axis that is substantially coaxially aligned with the drilling axis when the top drive motor is being operated in drilling operations; means for raising or lowering the top drive assembly in the drilling mast to a first predetermined position above a drilling platform on the drilling rig, said first predetermined position suitable for the top drive assembly to connect with a joint of pipe, the joint of pipe having a box end and a pin end defining a longitudinal axis between said ends; means for moving the joint of pipe to a second predetermined position adjacent to the drilling platform suitable for connecting the joint of pipe to the top drive assembly, the joint of pipe having the box end pointed toward the top drive assembly, means for tilting the top drive motor about a substantially horizontal axis until the quill is pointed toward the box end of said pipe and substantially aligned coaxially with the longitudinal axis of said pipe; means for pushing the joint of pipe along its longitudinal axis from the second predetermined position toward the top drive motor whereby the box end may be threadably engaged to the quill; and means for grasping and pulling the joint of pipe along its longitudinal axis toward the top drive motor.

Yet another aspect of the present invention is a top drive assembly for use in a drilling rig, comprising a top drive frame adapted for being raised and lowered in a drilling mast of the drilling rig, the drilling mast defining a substantially vertical drilling axis, a top drive motor having a quill adapted for connection with a joint of pipe, the quill capable of rotation about a longitudinal axis that is substantially coaxially aligned with the drilling axis when the top drive motor is being operated in drilling operations, the top drive motor pivotally attached to the top drive frame whereby the top drive motor is capable of tilting about a substantially horizontal axis; means for tilting the top drive motor about the horizontal axis with respect to the top drive frame thereby tilting the longitudinal axis of the quill from the substantially vertical drilling axis, and means for grasping a joint of pipe, said means operatively attached to the top drive motor, said means capable of grasping a joint of pipe positioned beneath the top drive motor and pulling the joint of pipe toward the top drive motor for connection with the quill.

DETAILED DESCRIPTION OF THE INVENTION

Figure 1:
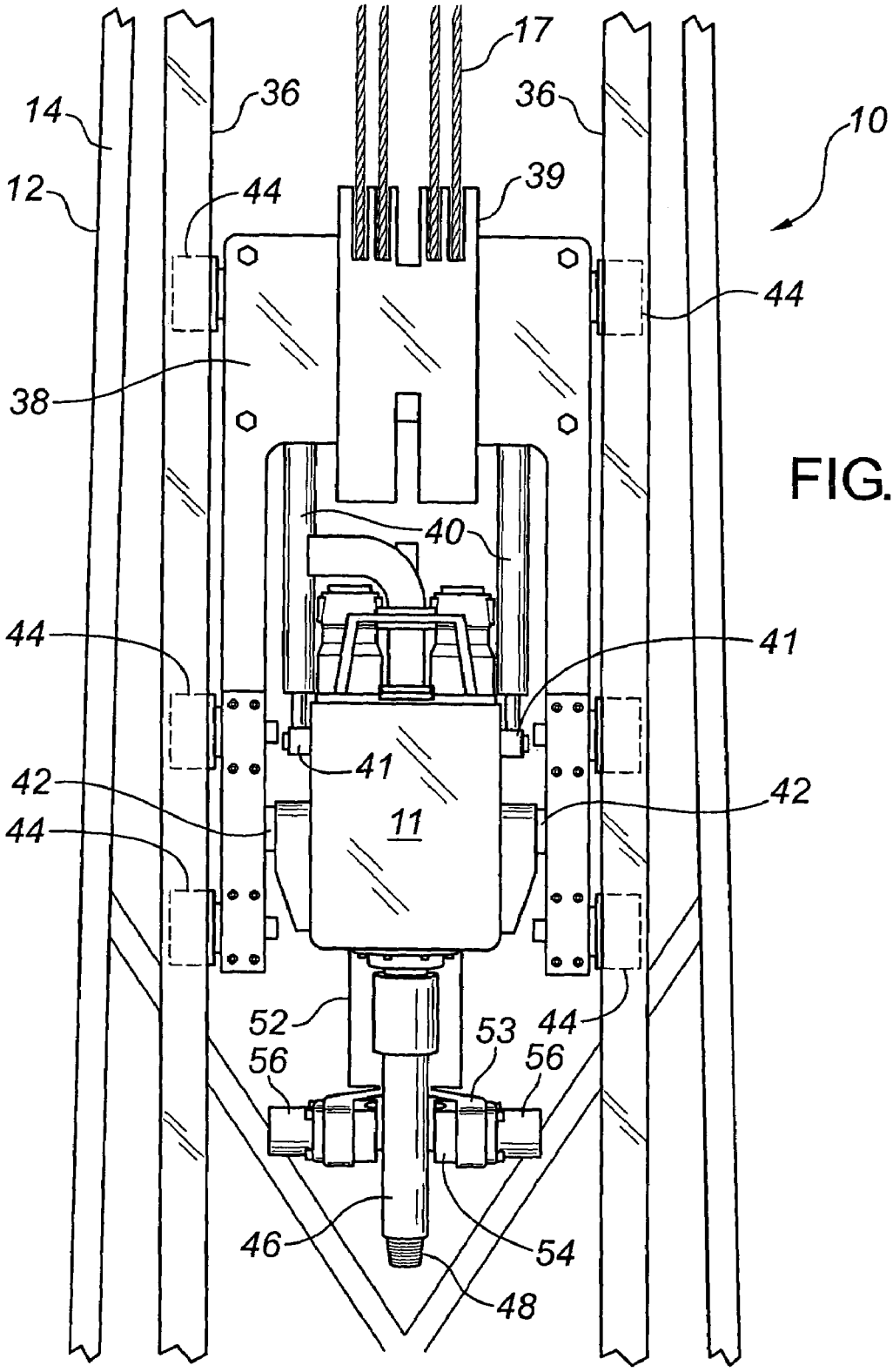
FIG. 1 is a front elevation view of the top drive assembly of the present invention.
Figure 2:
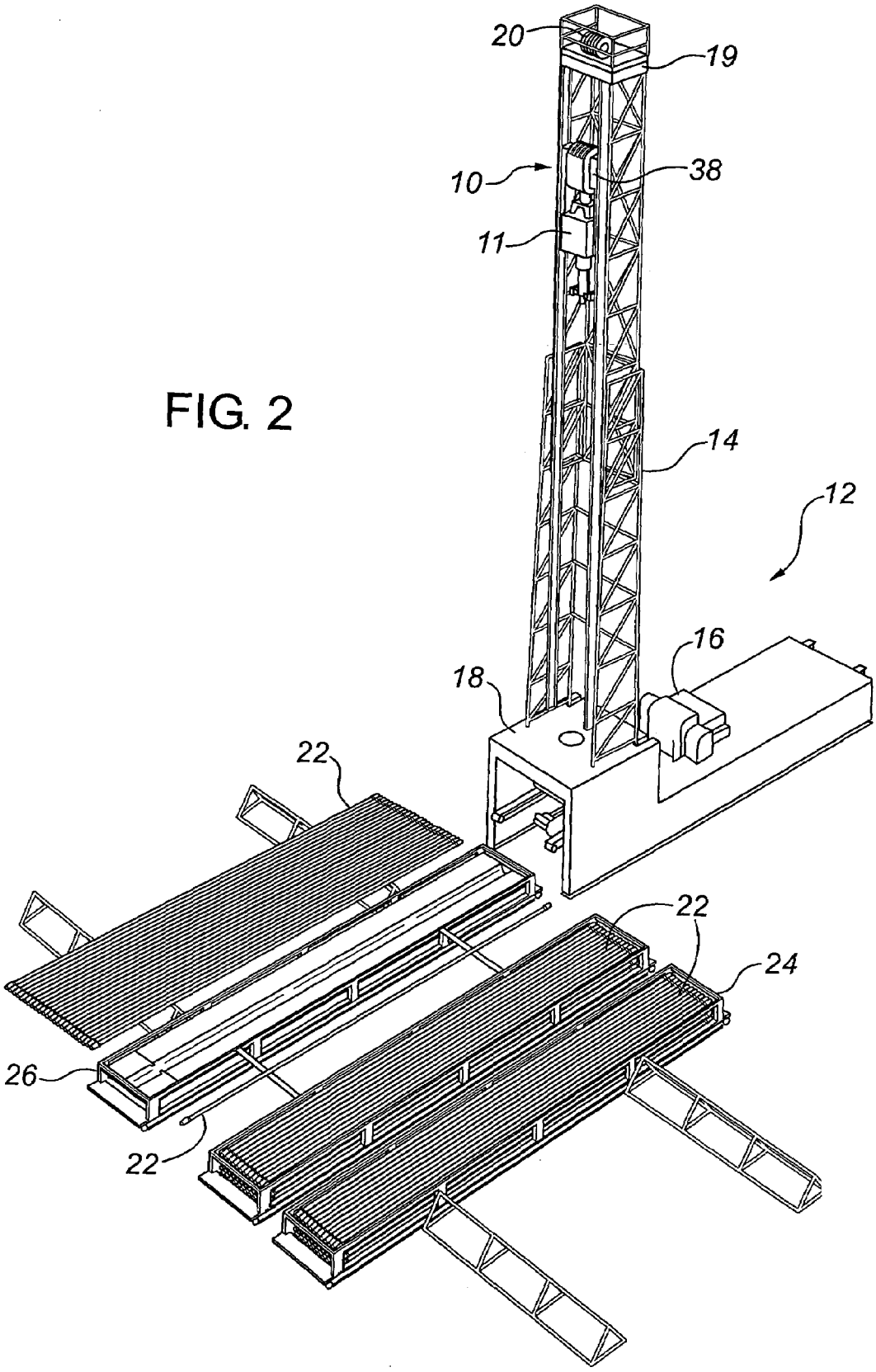
FIG. 2 is a perspective view of a drilling rig in which the top drive assembly of the present invention is used.

Referring to FIGS. 1 and 2, the top drive assembly is shown mounted in drilling mast 14. Assembly 10 comprises top frame 38 having guide rollers 44 that travel in guide tracks 36 in mast 14. Preferably, frame 38 has three rollers 44 on each side of the frame. Frame 38 is supported in mast 14 by cable 17 as it wraps around top drive pulleys 39. Cable 17 also wraps around upper pulleys 20 mounted on platform 19 on mast 14. One end of the cable is fastened to top drive frame 38 (or upper pulley 20) while the other end is attached to draw works 16 on rig 12 which reels in or reels out cable 17 to either raise or lower top drive assembly in mast 14.

Top drive motor 11 is pivotally attached to top drive frame 38 at pivot points 42. Motor 11, typical for that of top drive motors, having a horsepower rating in the 150 to 500 horsepower range. Motor 11 rotates or tilts within frame 38 by pivoting on pivot points 42. Hydraulic cylinders 40 having one end attached to frame 38 while the other end is attached to motor 11 at attachment point 41. Motor 11 comprises quill 46 which has pin threads 48 on the end of the quill for attaching to joints of pipe. Motor 11 further comprises slider assembly 50. Slider assembly 50 comprises slider mechanism 52 that is adapted to slide up and down along an axis parallel to the longitudinal axis of quill 46. Slider mechanism 52 further comprises pipe clamp subassembly 53 that holds pipe clamps 54 and pipe clamp actuators 56. Pipe clamps 54 grasp a joint of pipe and draw it toward motor 11 for connection with quill 46.

Figure 3:
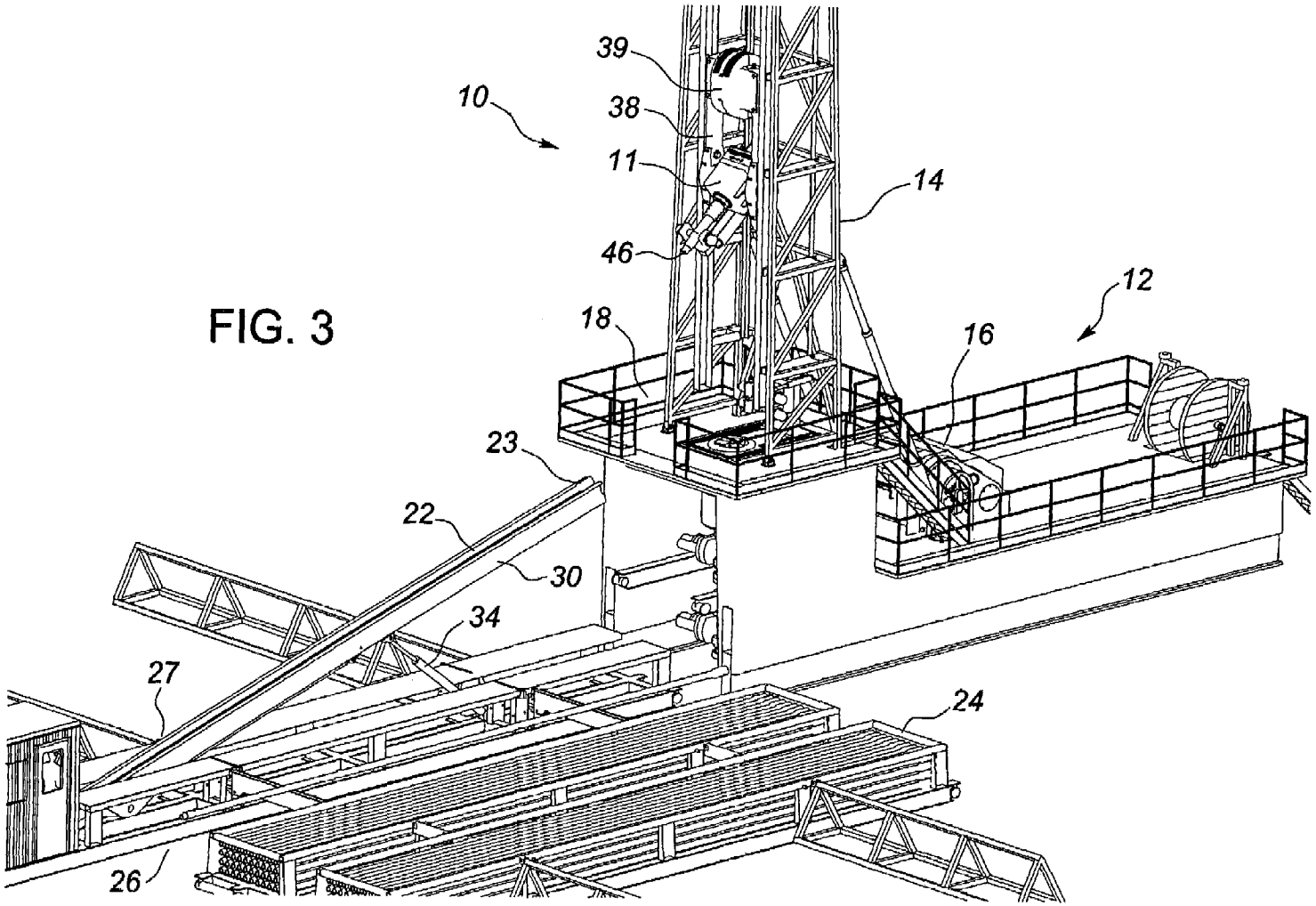
FIG. 3 is a perspective view of the drilling rig of FIG. 2 showing a pipe launcher raising a joint of pipe and with the top drive assembly descending the mast to receive the pipe.

Referring to FIG. 2, pipe 22 is taken from pipe tub 24 and loaded onto pipe launcher 26. Referring to FIG. 3, pipe 22 is raised by ramp 30 as cylinder 34 extends in length thereby causing ramp 34 to rotate about pivot point 27. In doing so, one end of ramp 30 is raised toward platform 18 of drilling rig 12. In raising ramp 30, box end 23 of pipe 22 is set pointing toward platform 18 at a predetermined angle to be determined by the height of drilling platform 18 and the distance between rig 12 and pipe launcher 26. Meanwhile, top drive assembly 10 is lowered in mast 14 by draw works 16 and motor 11 is tilted within frame 38 by cylinders 40 causing quill 46 to tilt toward pipe 22 laying ramp 30.

Figure 4:
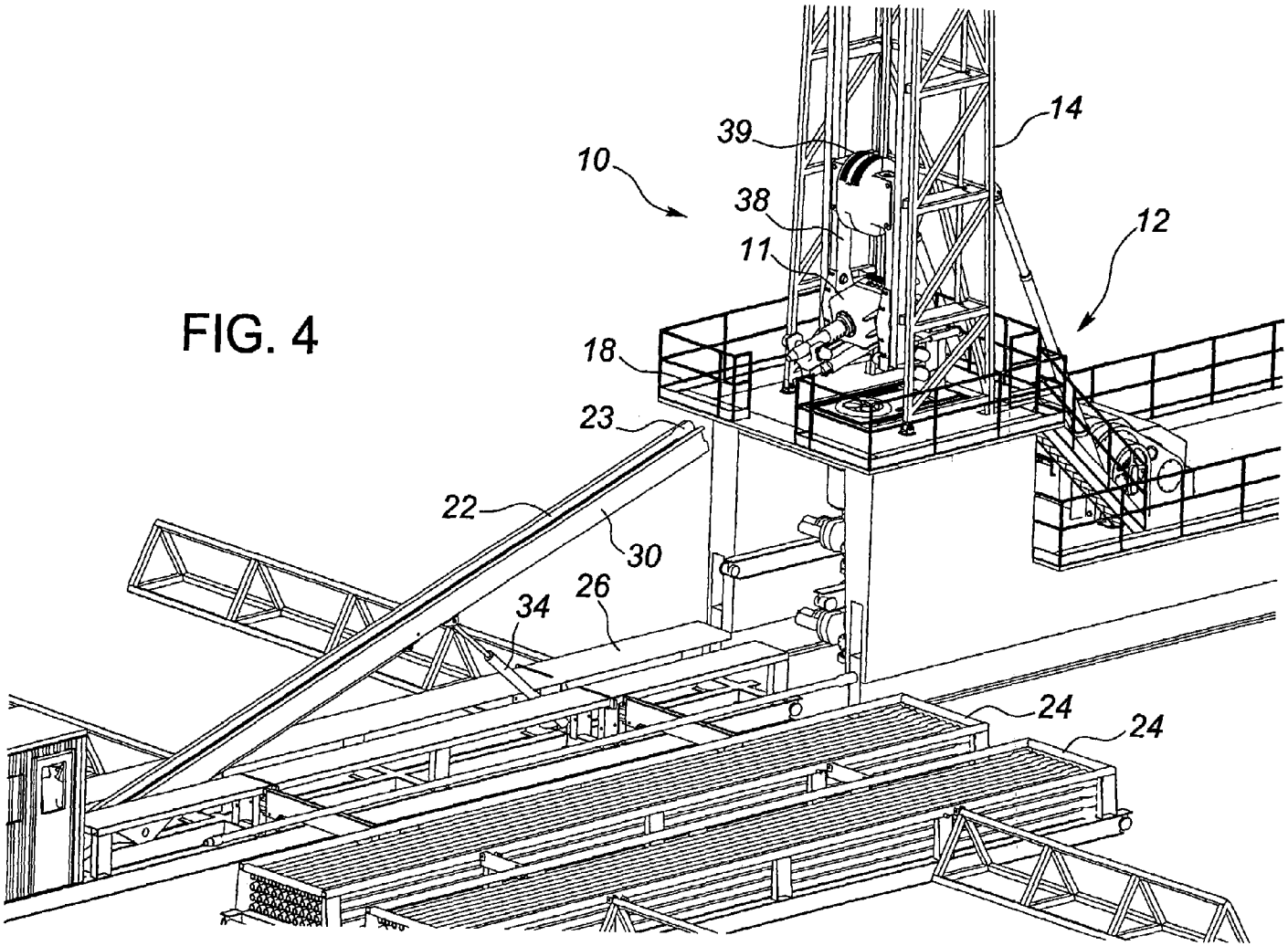
FIG. 4 is a perspective view of the present invention with the top drive motor positioned and titled within the drilling mast to receive a joint of pipe.

Referring to FIG. 4, top drive assembly 10 is lowered to a predetermined position above platform 18 and motor 11 is tilted out at a predetermined angle such that quill 46 is pointed toward box end 23 and coaxially aligned with the longitudinal axis of pipe 22.

Figure 4A:
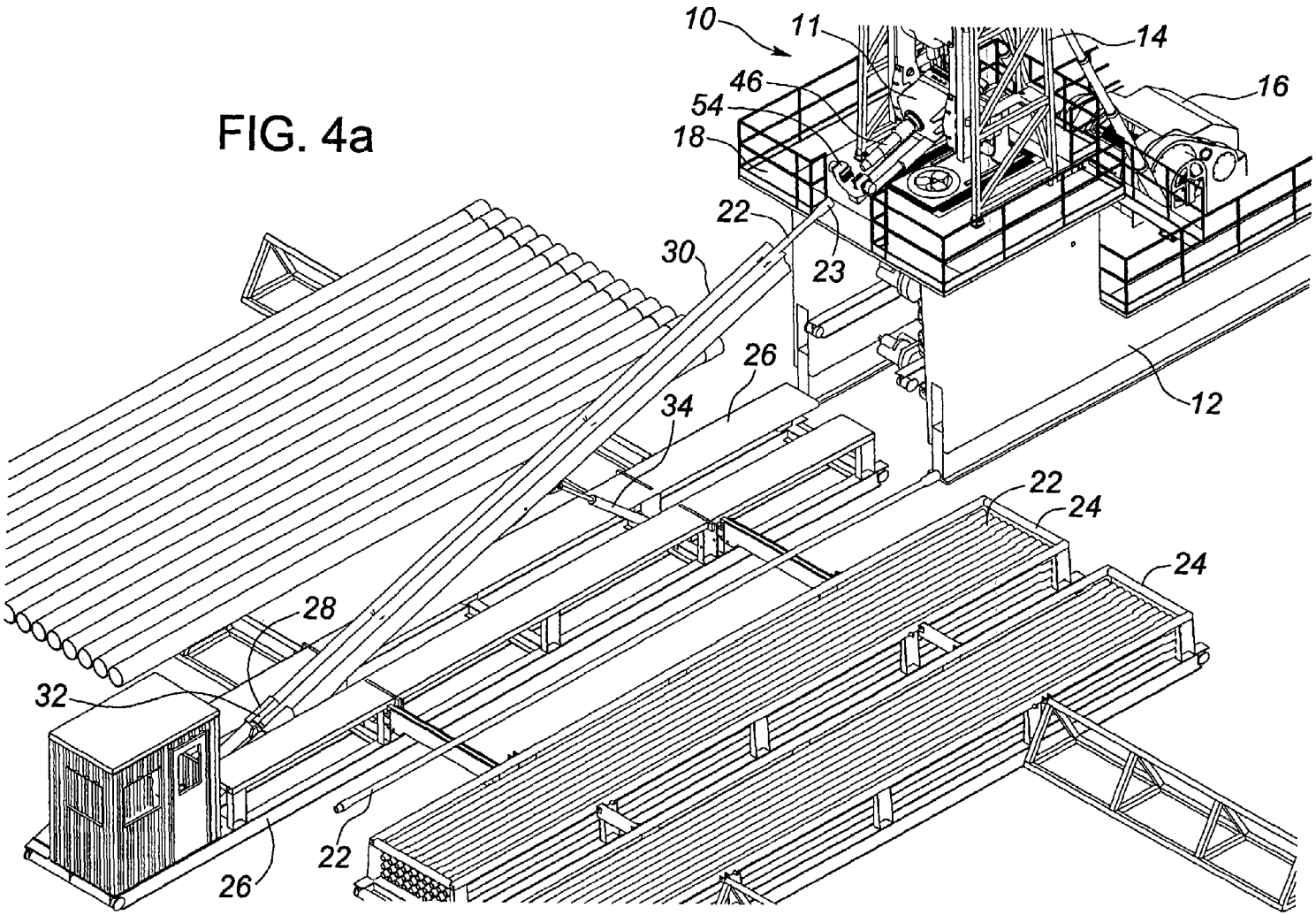
FIG. 4*a* is a perspective view of the present invention with the top drive motor positioned and titled within the drilling mast to receive a joint of pipe and the pipe launcher advancing the pipe toward the top drive motor for connection therewith.
Figure 5:
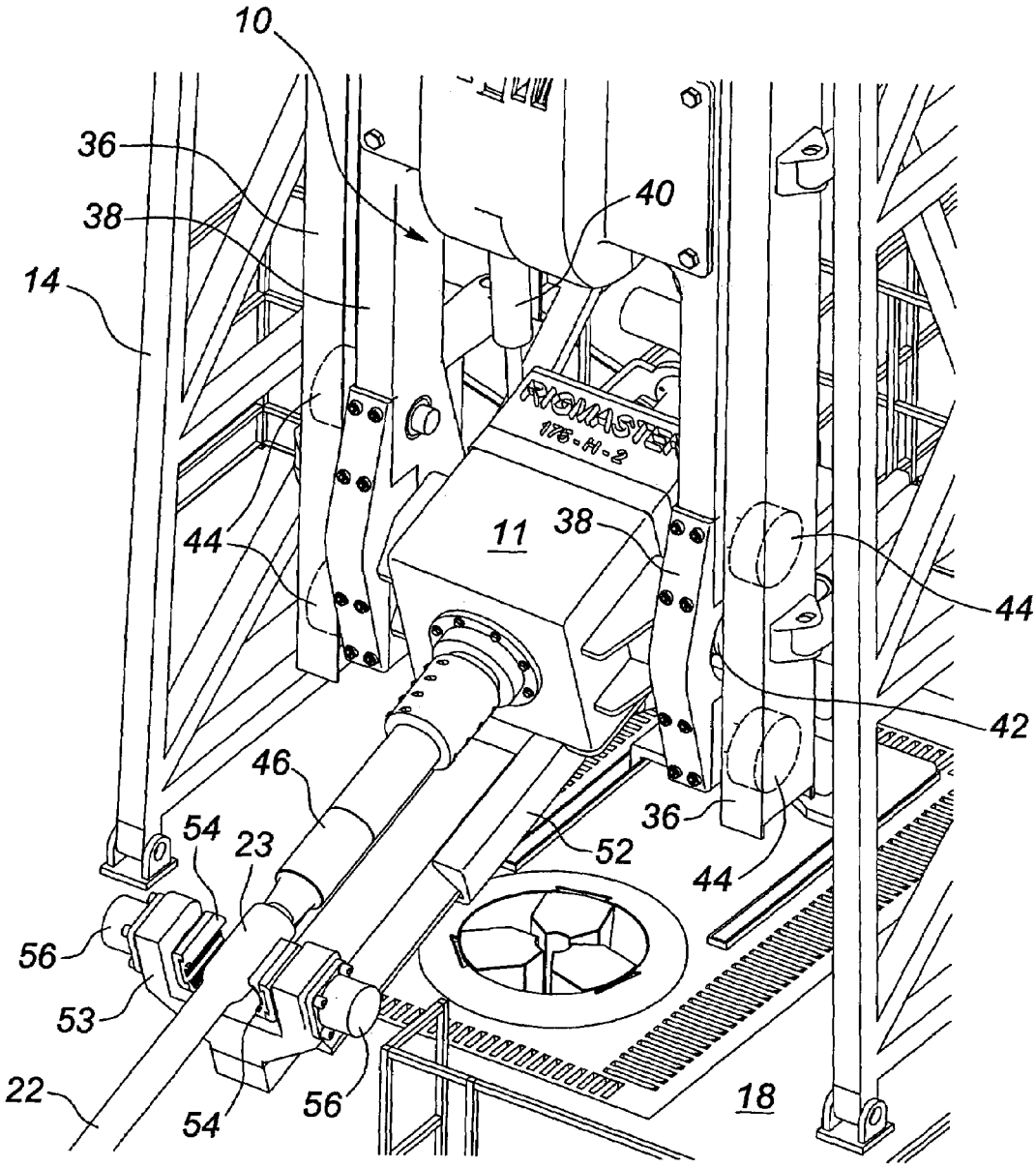
FIG. 5 is a close-up perspective view of the present invention with a joint of pipe positioned to connect with the top drive motor.

Referring to FIG. 4A, pipe launcher buggy 28, which supports pin end 21 of pipe 22, pushes pipe 22 up ramp 30 to bring box end 23 toward quill 46 of motor 11. Referring to FIG. 5, slider mechanism 52 slides downwards until pipe clamps 54 are straddling box end 23 of pipe 22.

Figure 6:
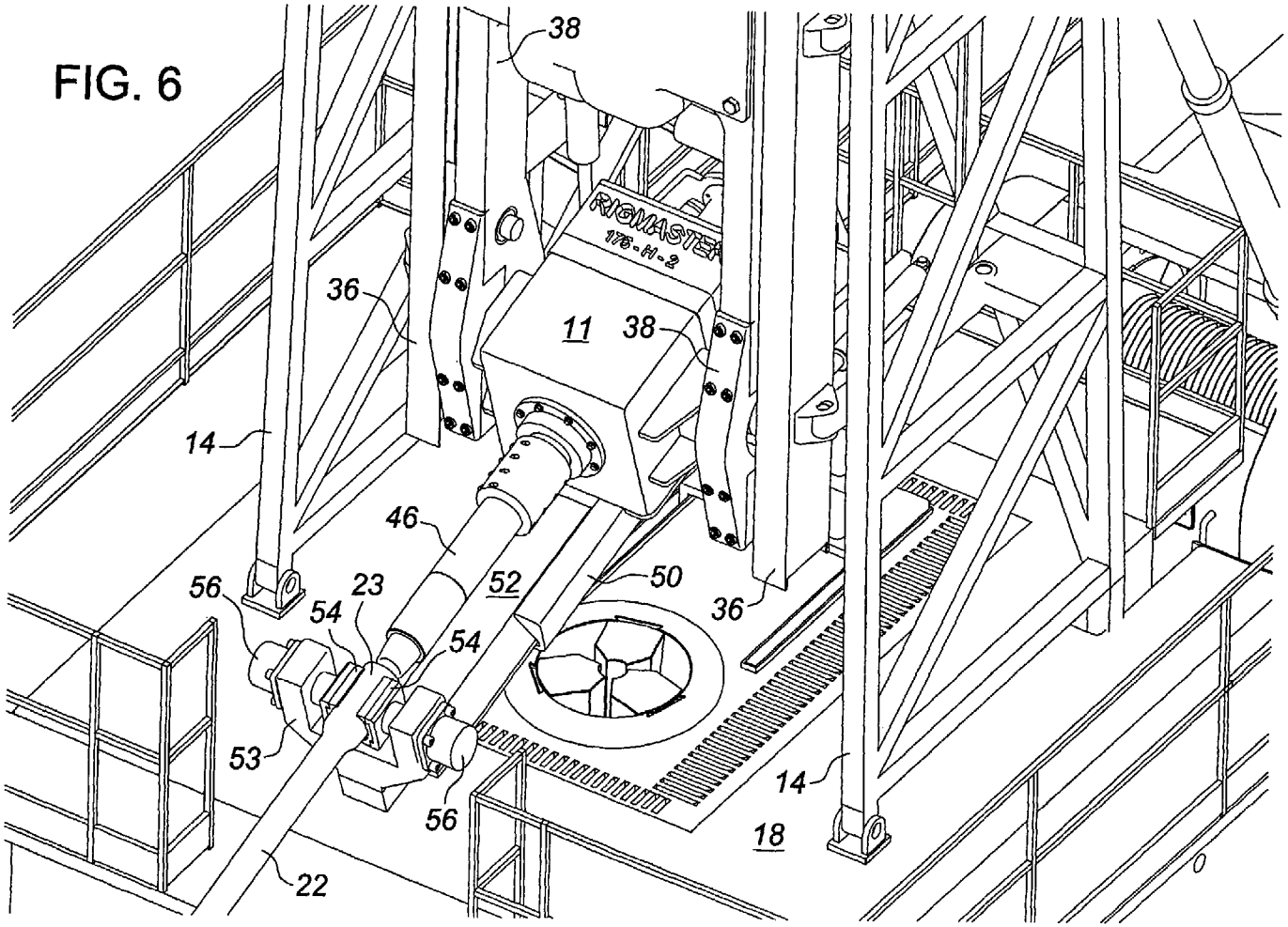
FIG. 6 is a close-up perspective view of the present invention with a joint of pipe gripped by the pipe clamps of the top drive motor.
Figure 7:
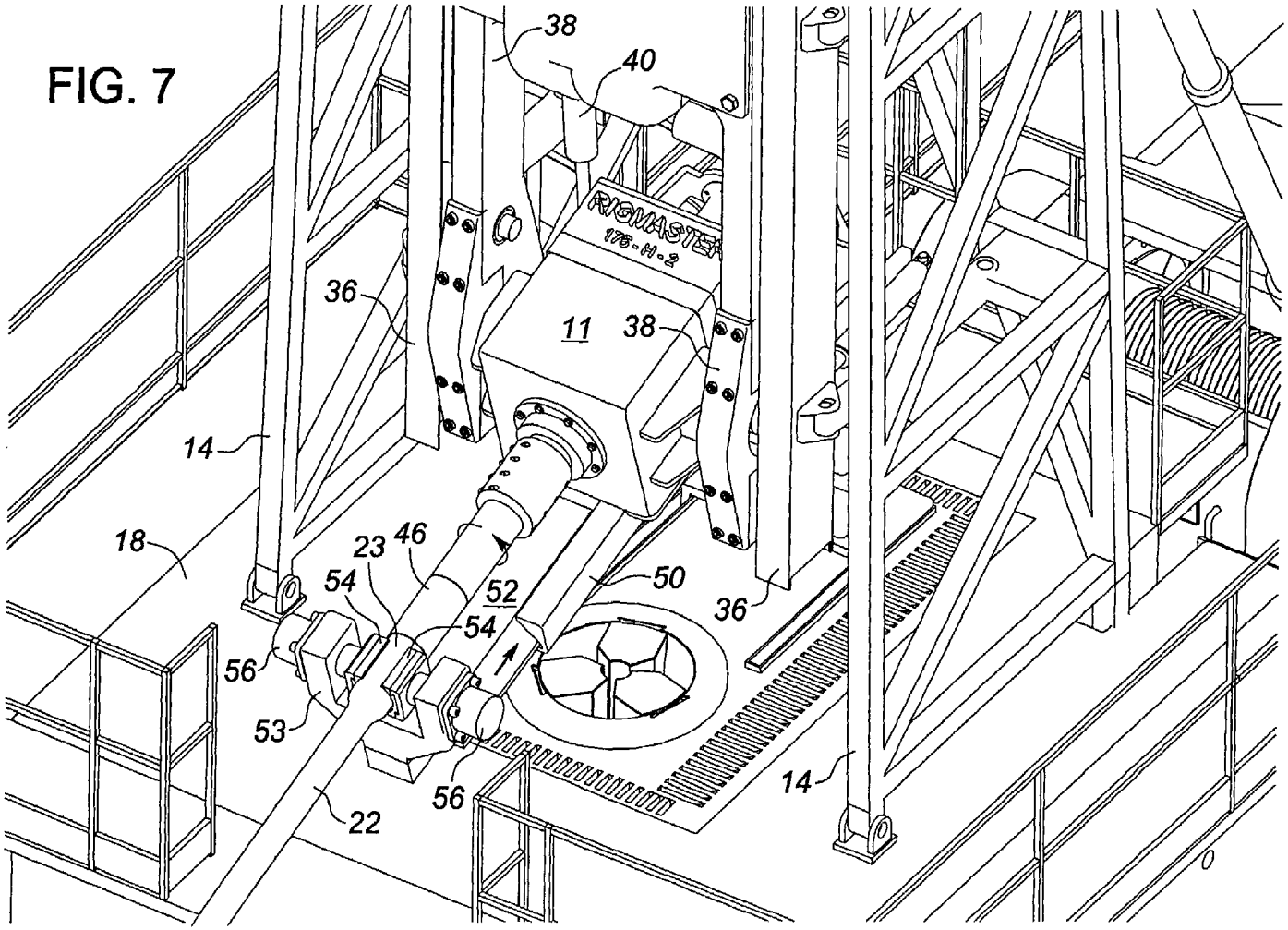
FIG. 7 is a close-up perspective view of the present invention with a joint of pipe connected to the top drive motor.

Referring to FIG. 6, actuators 56 move pipe clamps 54 in to grasp box end 23 of pipe 22. Referring to FIG. 7, slider mechanism 52 retracts upwards toward motor 11. Quill 46 is rotated such that quill threads 48 engage box end 23 of pipe 22 as it is drawn toward motor 11.

Figure 8:
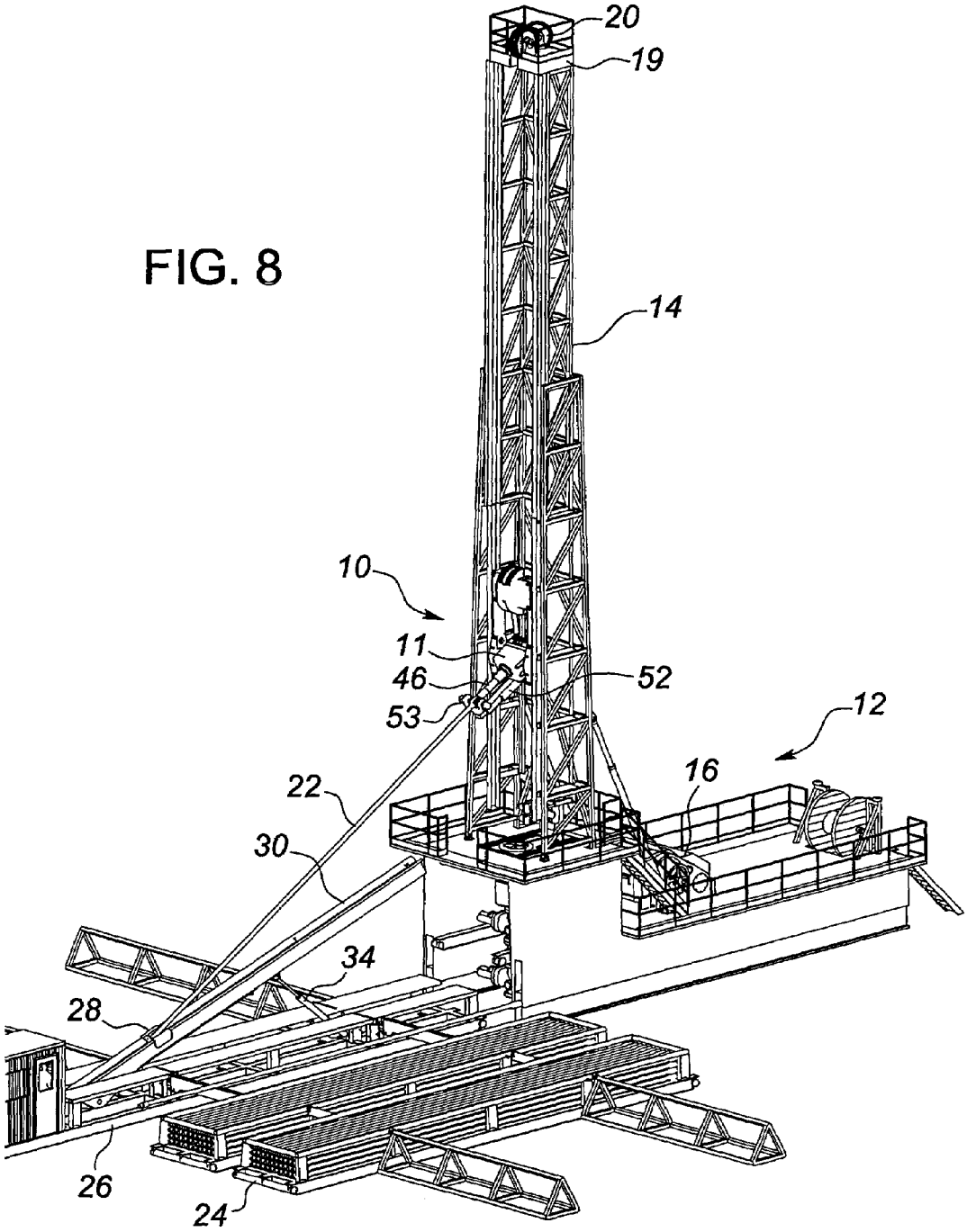
FIG. 8 is a perspective view of the present invention with the top drive assembly ascending in the drilling mast and drawing up a joint of pipe.

After quill 46 has threadably engaged box end 23 of pipe 22, pipe clamps 54 maintain their grip on box end 23 to support pipe 22 as it is drawn up into mast 14 by top drive assembly 10. Referring to FIG. 8, top drive assembly 10 is raised in mast 14 by draw works 16. Simultaneously, motor 11 rotates within frame 42 on pivot points 42 by cylinders 40. In addition, buggy 28 is advanced up along ramp 30 to support pin end 21 of pipe 22 as it is being raised by top drive assembly 10.

Figure 9:
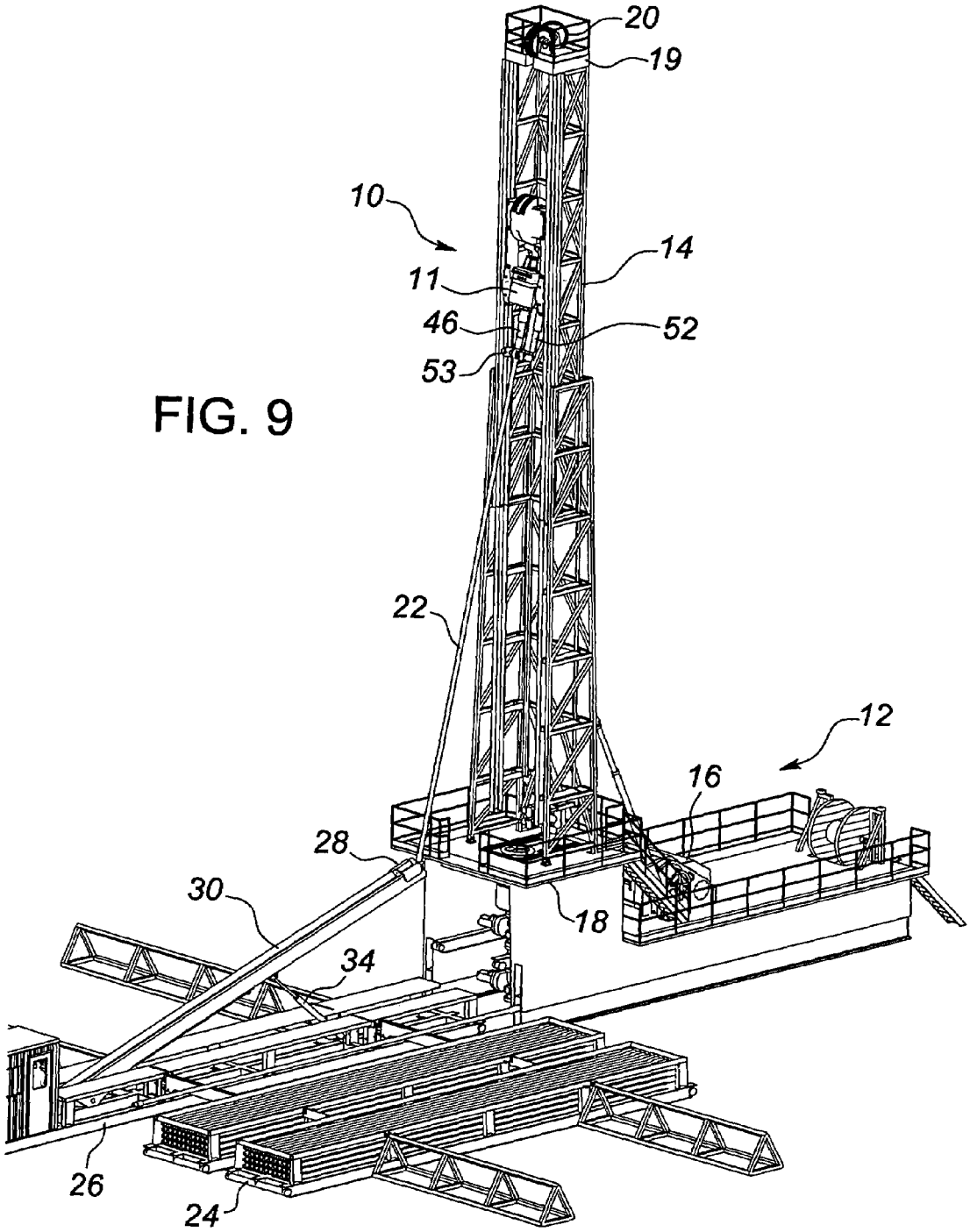
FIG. 9 is a perspective view showing the top drive assembly near the top of the mast and the joint of pipe ready to be swung toward the drilling platform.
Figure 10:
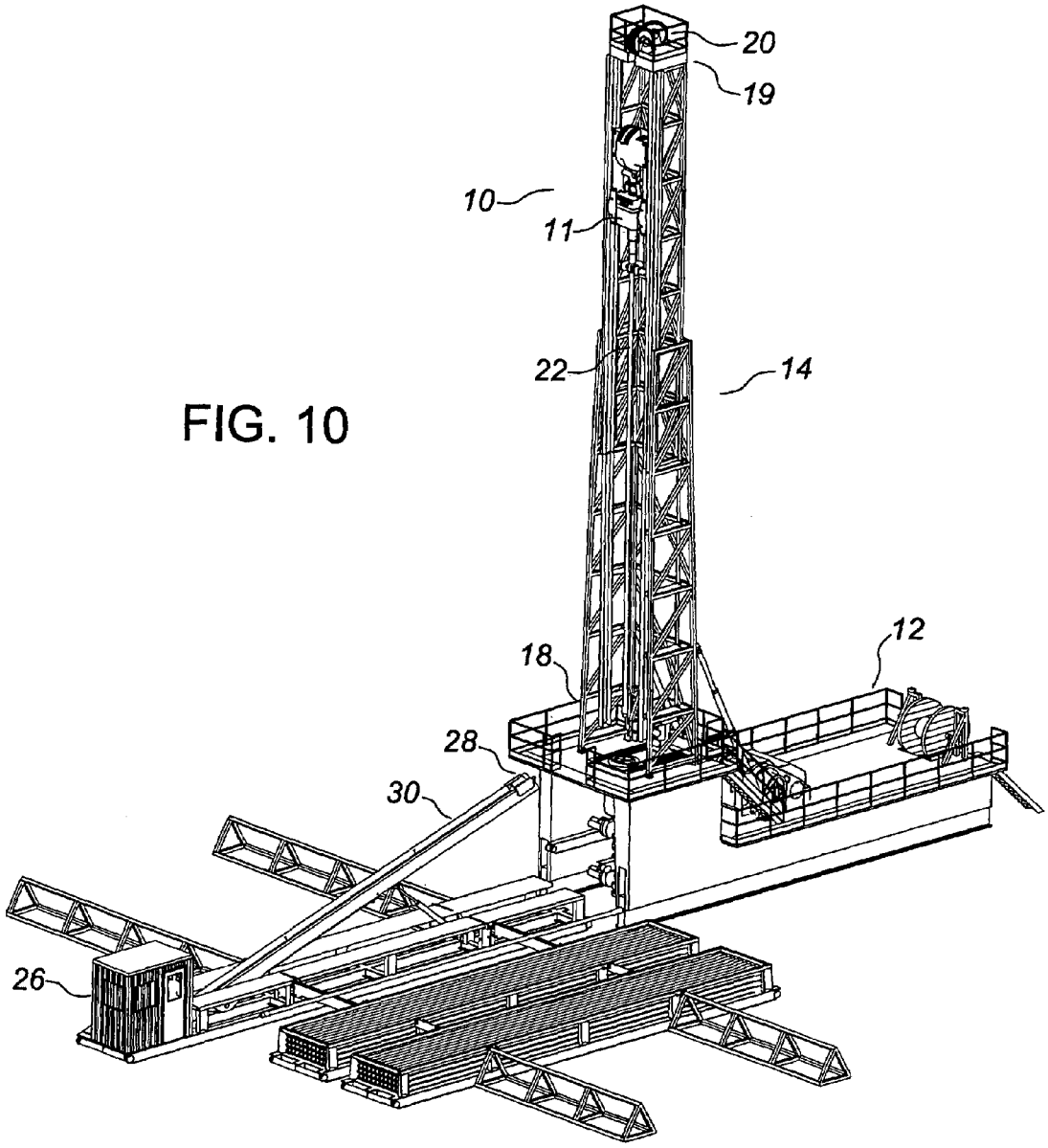
FIG. 10 is a perspective view of the present invention with the joint of pipe suspended in the mast above the drilling platform.
Figure 11:
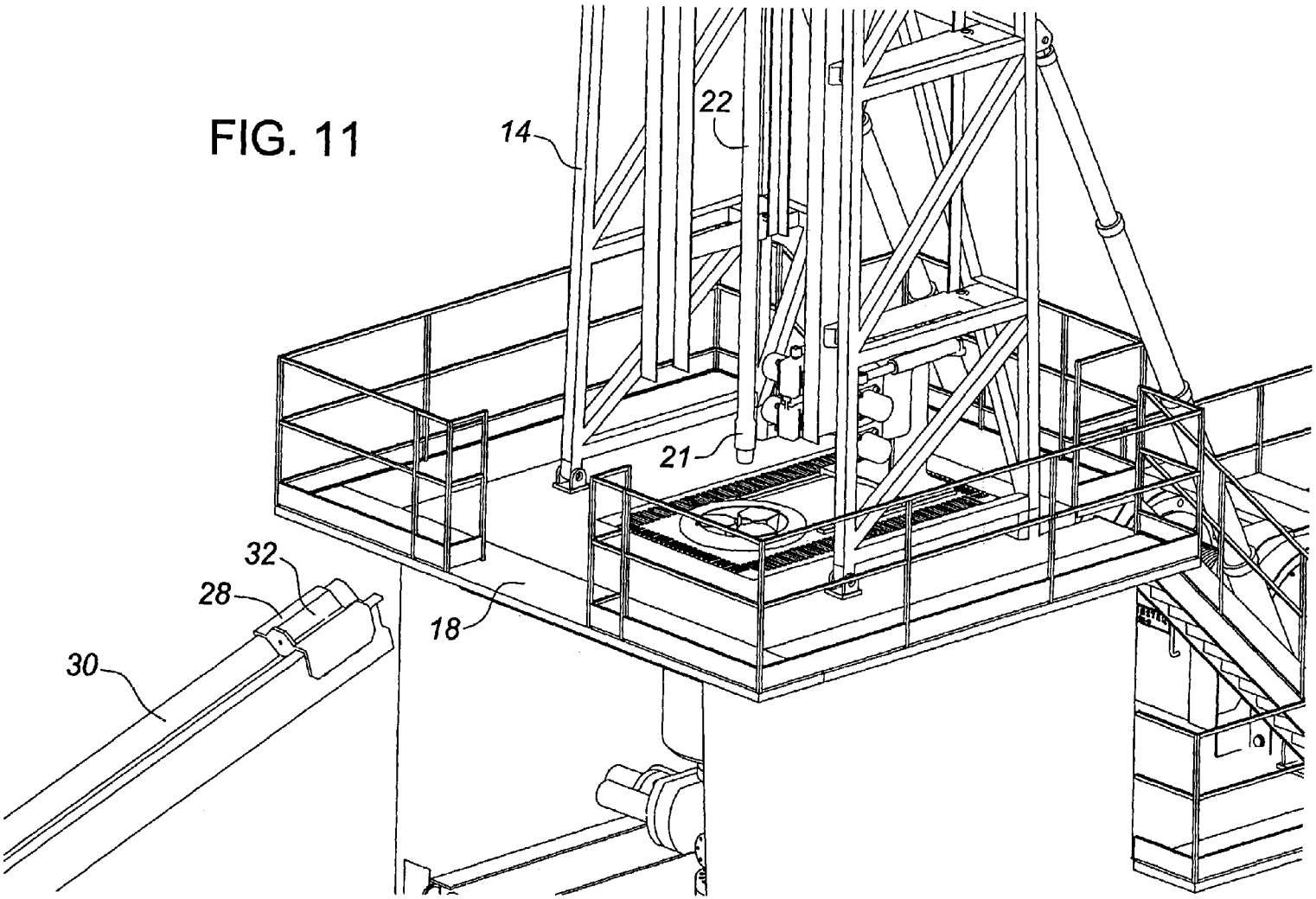
FIG. 11 is a close up perspective view of a joint of pipe suspended above the drilling platform by the top drive assembly.

Referring to FIG. 9, pipe 22 has been raised in mast 14 while buggy 28 has reached the upper end of ramp 30 ready to release pin end 21 of pipe 22. In FIG. 10 and 11, top drive assembly 10 is raised high enough in mast 14 such that pin end 21 of pipe 22 clears buggy 28. Motor 11 swings back to the vertical position within frame 38 such that pipe 22 hangs vertically in mast 14 with pin end 21 just above platform 18 at a safe working height for a drilling operator. In this position, a drill bit (not shown) may be attached to pin end 21 or pin end 21 may be attached to the drill string (not shown) already in position.

When drilling pipe is being tripped out from the drill string, the procedure is followed in reverse to store joints of pipe 22 back into pipe tub 24.

Figure 12:
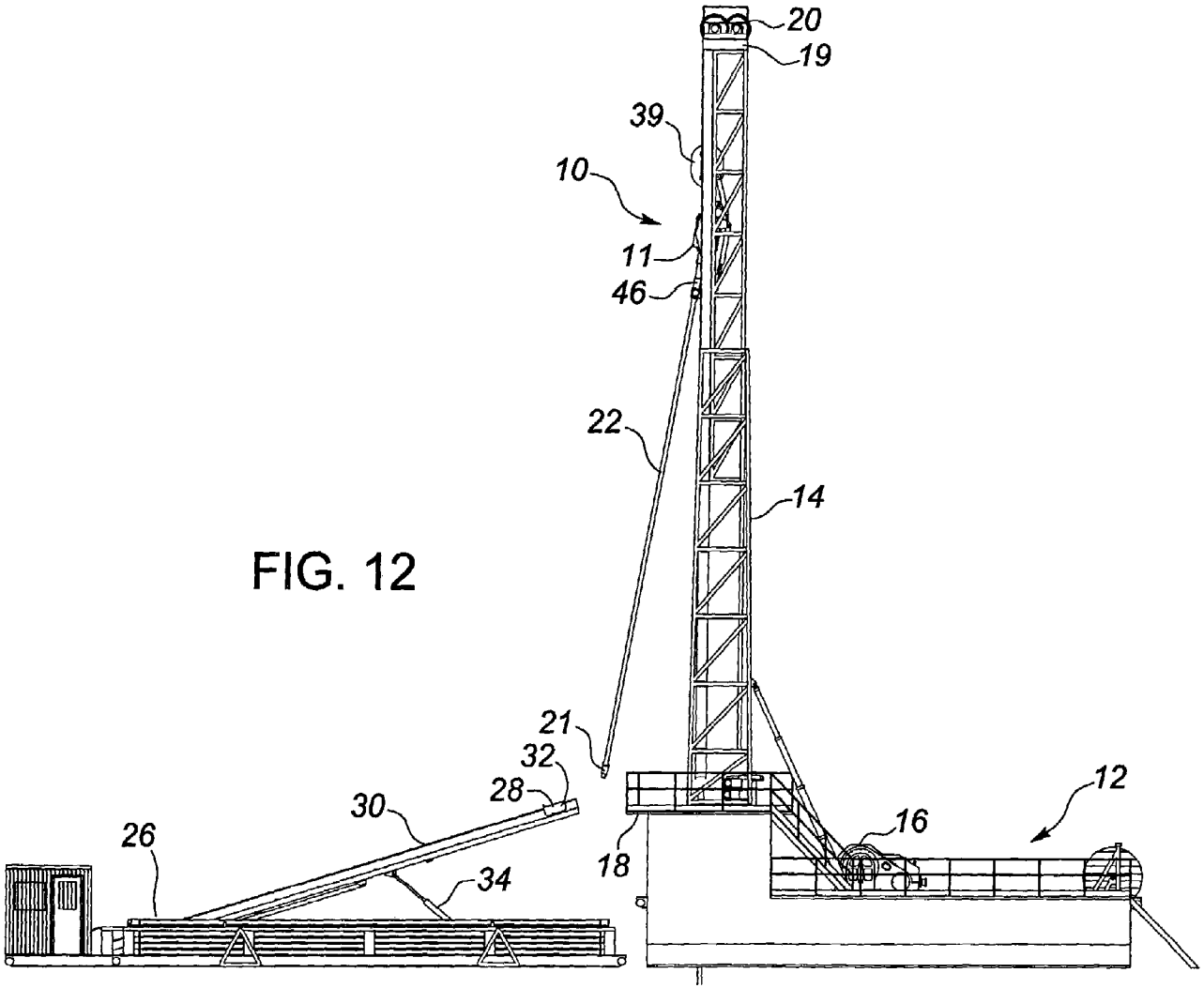
FIG. 12 is a side elevational view showing a joint of pipe swung out from the mast by the top drive assembly as it is tripped out from the drill string.
Figure 13:
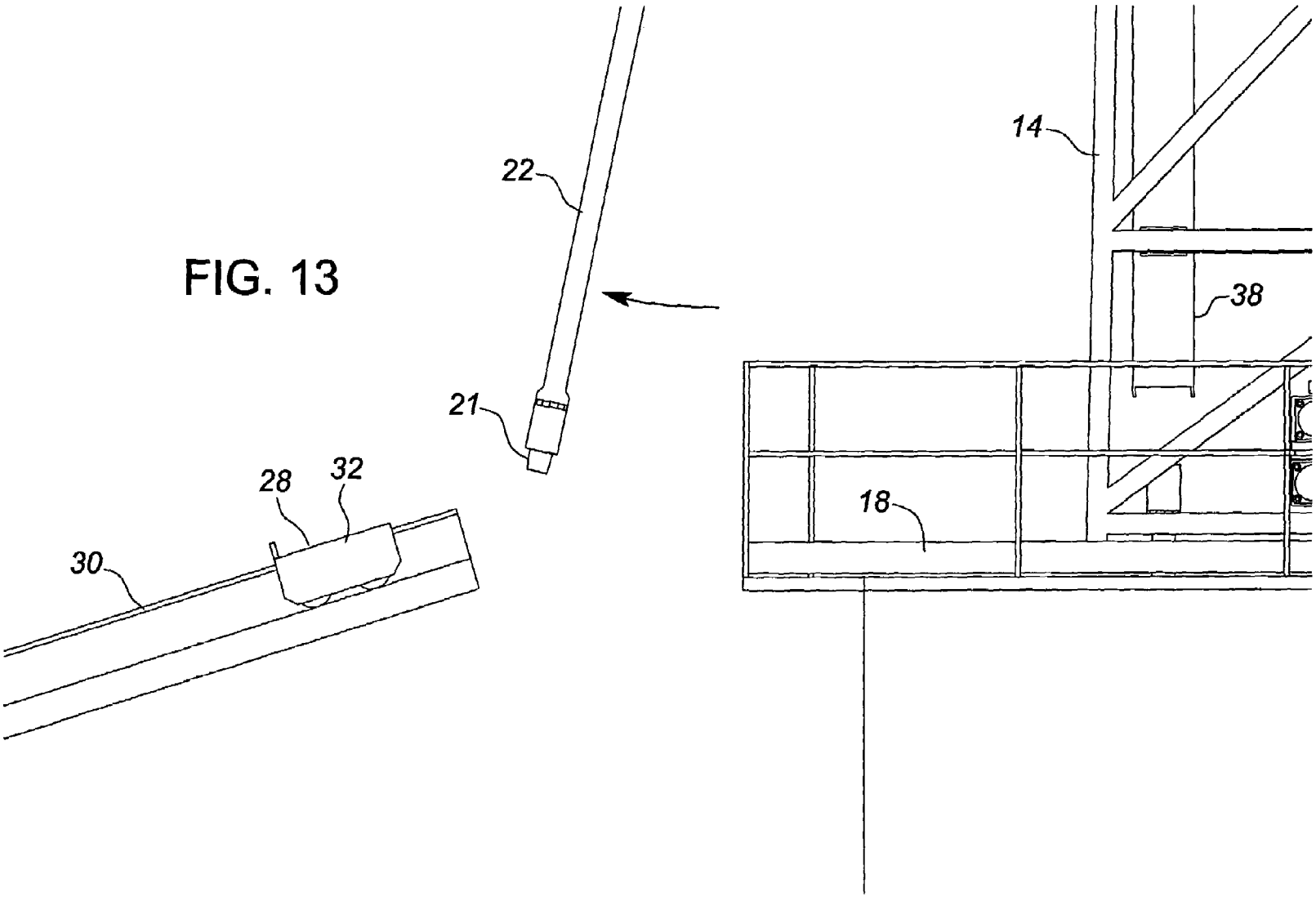
FIG. 13 is a side elevational view of the pin end of the pipe joint to be received by the buggy of the pipe launcher as the pipe joint is being tripped out.

Referring to FIG. 12, gripper assembly 50 is activated to grasp and support box end 23 of pipe 22 as motor 11 is tilted within frame 38 to bring pin end 21 out from mast 14 to be received by buggy 28 as top drive assembly 10 is lowered in mast 14. Referring to FIG. 13, pin end 21 is swung toward buggy 28 as top drive assembly 10 is lowered such that pin end 21 will rest in rubber insert 32 of buggy 28.

Figure 14:
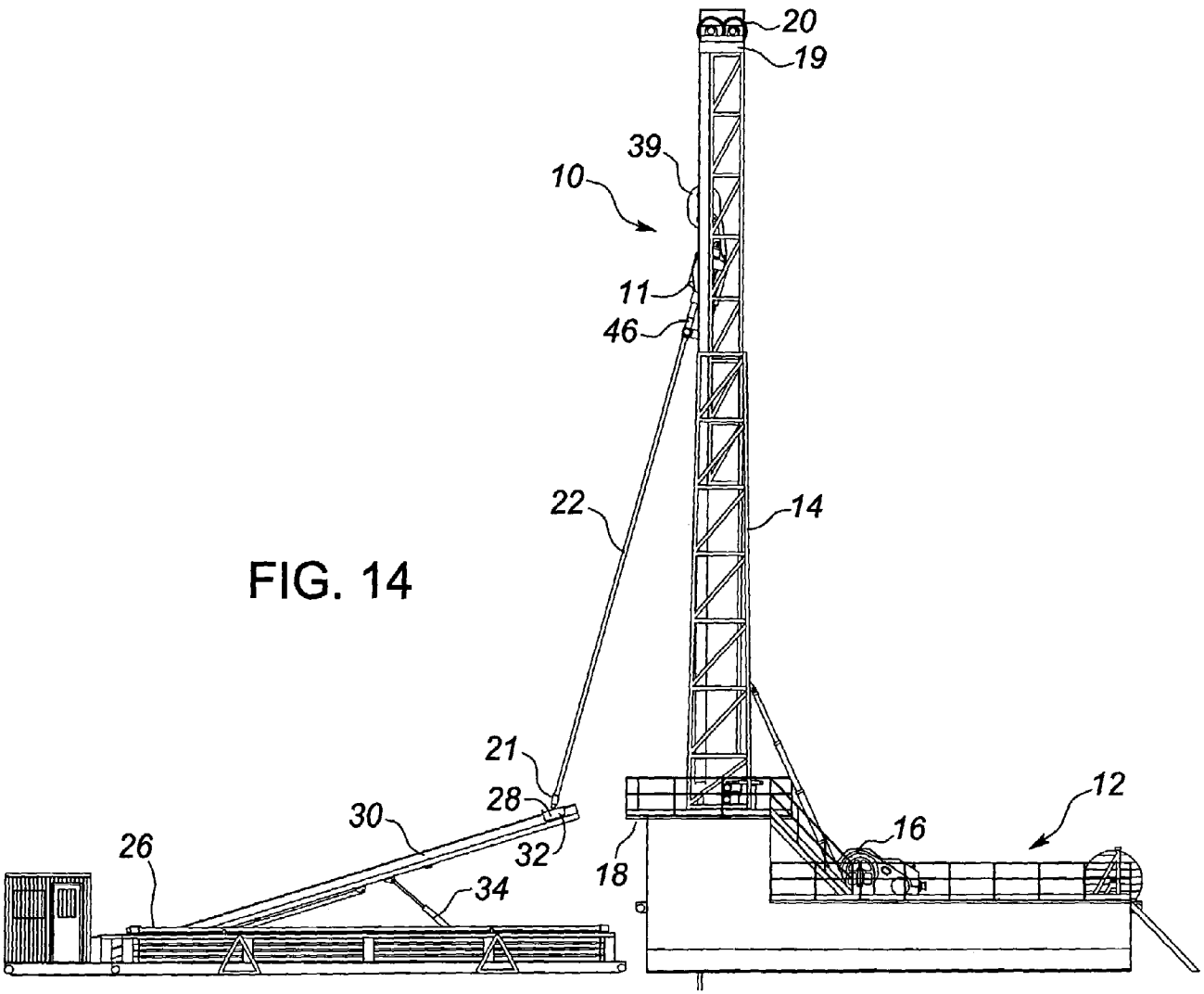
FIG. 14 is a side elevational view showing the pipe joint being received by the pipe launcher as the top drive assembly begins its descent in the drilling mast.
Figure 15:
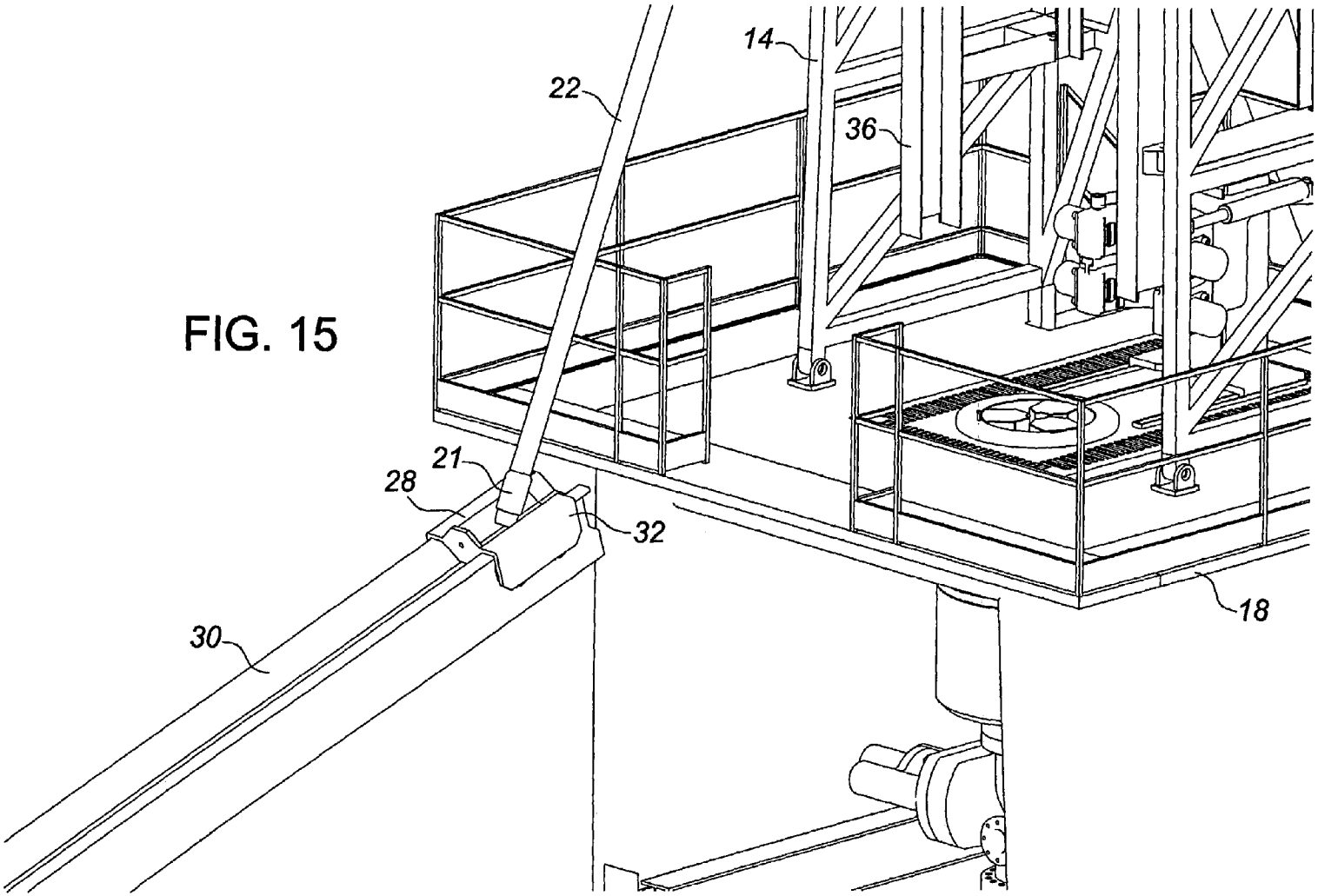
FIG. 15 is a close-up perspective view of the present invention as the pin end of the joint of pipe is positioned in the buggy of the pipe launcher.
Figure 16:
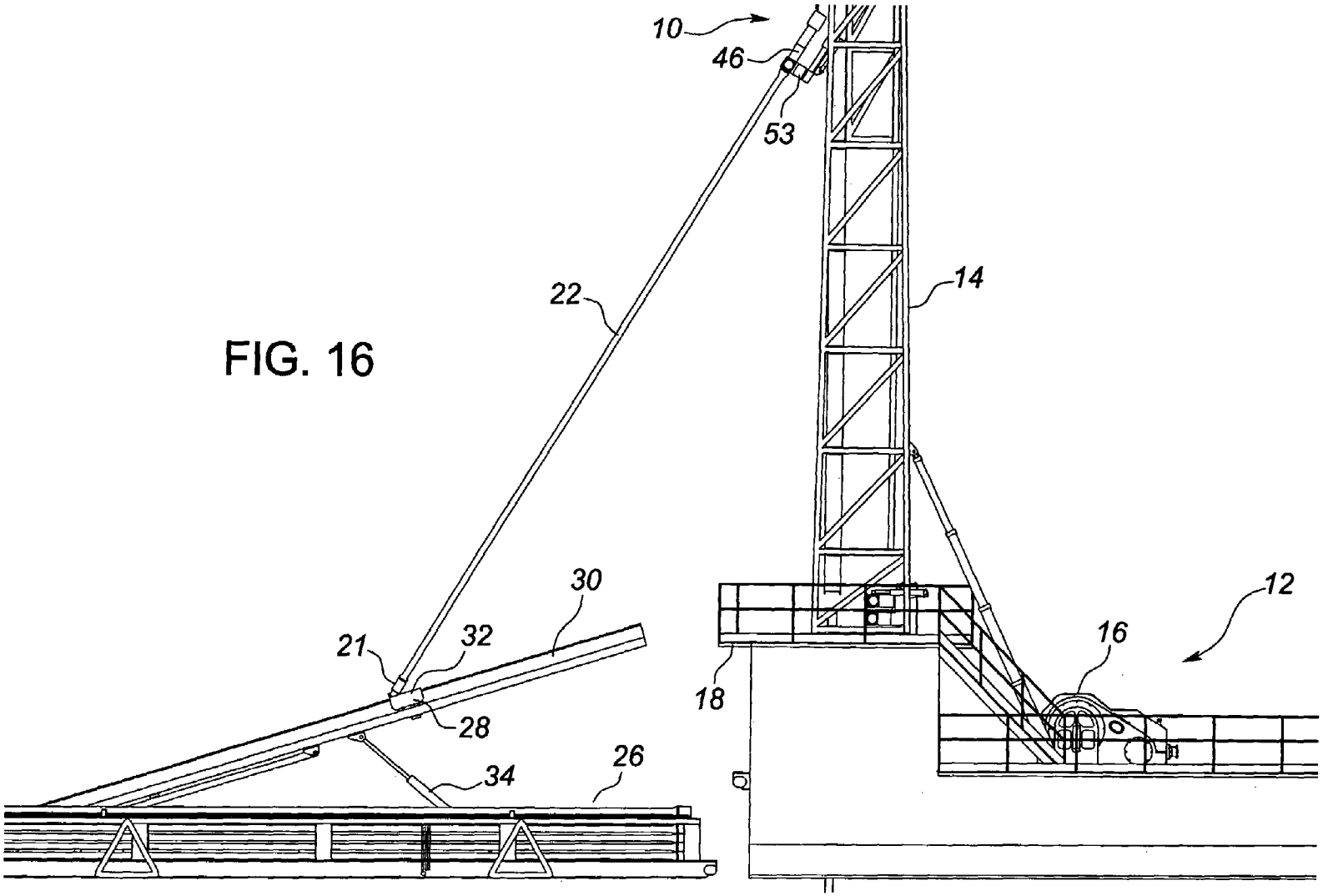
FIG. 16 is a side elevational view showing the joint of pipe received by the pipe launcher as the top drive assembly is descending in the mast.
Figure 17:
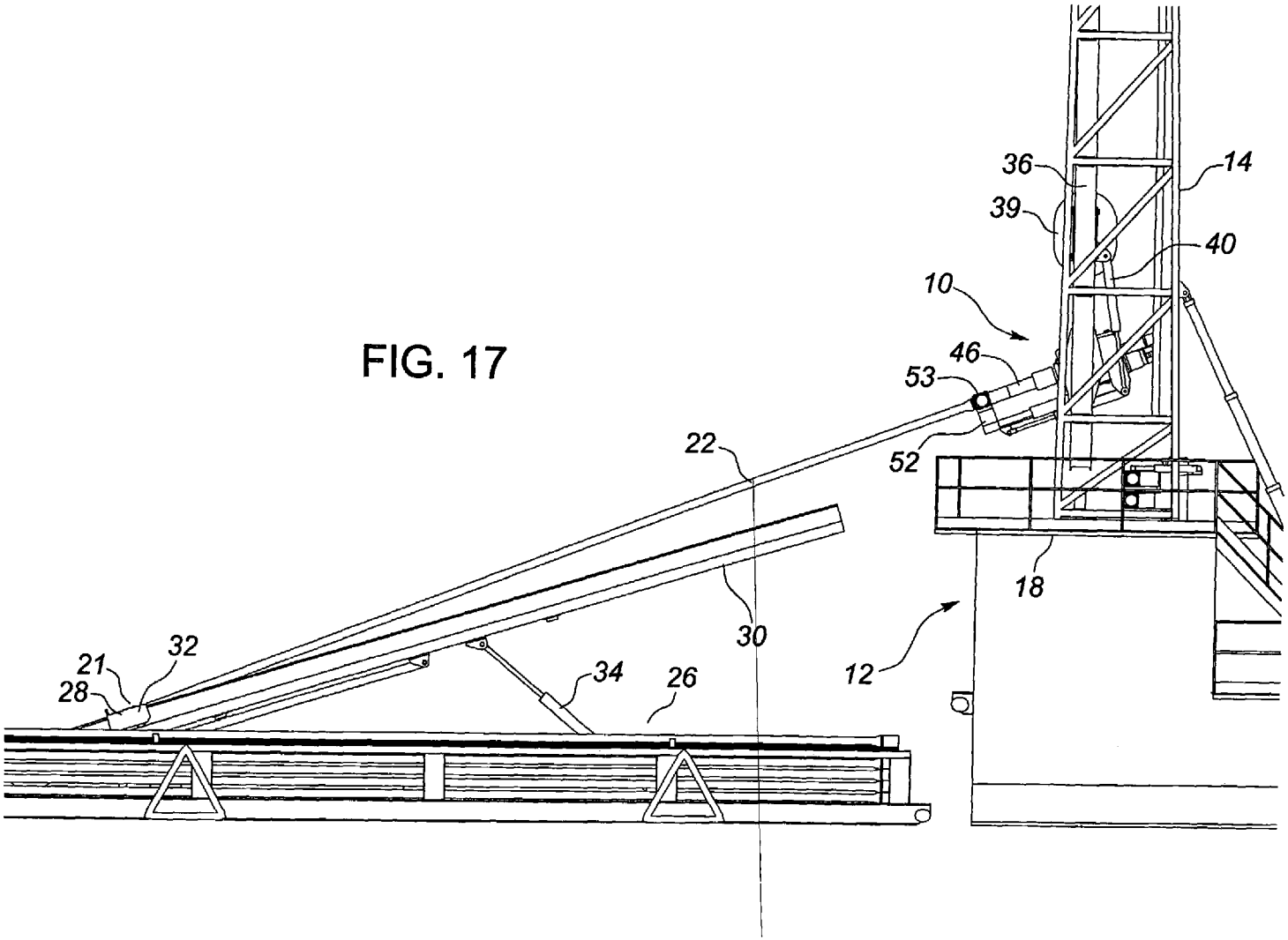
FIG. 17 is a side elevational view showing the joint of pipe received by the pipe launcher and as the top drive assembly prepares to disconnect the joint of pipe.

Referring to FIGS. 14 and 15, pin end 21 is supported by buggy 28 as it descends down ramp 30. Referring to FIG. 16, buggy 28 travels down ramp 30 supporting pin end 21 as top drive assembly 10 is lowered in mast 14 by draw works 16. Eventually, as shown in FIG. 17, pipe 22 will be lying flat in ramp 30 as top drive assembly 10 is lowered to a position just above platform 18. Simultaneously, motor 11 is rotating within frame 38. In this position, quill 46 is then rotated to disengage box end 23 as gripper assembly 50 pushes pipe 22 away from motor 11. After quill 46 is free of box end 23, pipe clamps 54 are released and gripper mechanism 52 is retracted toward motor 11 thereby allowing pipe 22 to be lowered by pipe launcher 26 and then stored into pipe tub 24. Top drive assembly then is free to be raised in mast 14 to trip out the next joint of pipe.

Buggy 28 then continues to descend ramp 30, pulling pipe 22 away from rig 12 until pipe 22 clears drilling platform 18. Ramp 30 is then lowered in pipe launcher 26 by cylinder 34. Once completely lowered, pipe 22 can then be removed from pipe launcher 26 for storage in pipe tub 24.

Although a few preferred embodiments have been shown and described, it will be appreciated by those skilled in the art that various change and modifications might be made without departing from the scope of the invention. The terms and expressions in the preceding specification have been used therein as terms of description and not of limitation, and there is no intention in the use of such terms and expressions of excluding equivalents of the features shown and described or portions thereof, it being recognized as the scope of the invention as defined and limited only by the claims that follow.

I claim:

1. A method for connecting a joint of pipe to a top drive assembly using a pipe launcher, the top drive assembly located in a drilling mast of a drilling rig, the method comprising the steps of:

(a) raising or lowering the top drive assembly in the drilling mast to a first predetermined position above a drilling platform on the drilling rig, the top drive assembly having a top drive motor with a rotatable quill, said first predetermined position suitable for the top drive assembly to connect with a joint of pipe, the joint of pipe having a box end and a pin end defining a longitudinal axis between said ends;

(b) moving a joint of pipe with the pipe launcher to a second predetermined position adjacent to the drilling platform suitable for connecting the joint of pipe to the top drive assembly, the joint of pipe having the box end pointed toward the top drive assembly at a predetermined angle, the angle determined by the height of the drilling platform and the distance between the drilling rig and the pipe launcher;

(c) tilting the top drive motor about a substantially horizontal axis until the quill is pointed toward the box end of said pipe and substantially aligned coaxially with the longitudinal axis of said pipe;

(d) pushing the joint of pipe along its longitudinal axis from the second predetermined position toward the top drive motor whereby the box end of the pipe may be threadably engaged to the quill; and (e) gripping and pulling the joint of pipe along its longitudinal axis toward the top drive motor while simultaneously rotating the quill to threadably engage the box end of the pipe until the connection between the joint of pipe and the top drive assembly is substantially complete.

2. The method as set forth in claim 1 further comprising the steps of:

(a) raising the top drive assembly in the drilling mast while the top drive motor simultaneously rotates back to a nearly vertical orientation thereby pulling the joint of pipe up into the drilling mast until the pin end is clear of the drilling platform; and (b) continuing to rotate the top drive motor to its vertical orientation thereby placing the pin end of the pipe above the drilling platform.

3. The method as set forth in claim 1 further comprising the step of connecting the pin end of the pipe to a drill string or to a drill bit for drilling a well.

4. A system for connecting a joint of pipe to a top drive assembly located in a drilling mast of a drilling rig, the drilling mast defining a substantially vertical drilling axis, the system comprising:

a top drive assembly having a top drive motor with a quill capable of rotation about an axis that is substantially coaxially aligned with the drilling axis when the top drive motor is being operated in drilling operations, the top drive assembly further comprising a top drive frame adapted for being raised and lowered in the drilling mast, the top drive motor pivotally attached to the top drive frame whereby the top drive motor is capable of tilting about a substantially horizontal axis;

means for raising or lowering the top drive assembly in the drilling mast to a first predetermined position above a drilling platform on the drilling rig, said first predetermined position suitable for the top drive assembly to connect with a joint of pipe, the joint of pipe having a box end and a pin end defining a longitudinal axis between said ends;

a pipe launcher for moving the joint of pipe to a second predetermined position adjacent to the drilling platform suitable for connecting the joint of pipe to the top drive assembly, the joint of pipe having the box end pointed toward the top drive assembly, the pipe launcher having a ramp, the pipe launcher adapted to raise and tilt the joint of pipe from a pipe loading position where the pipe is loaded onto the ramp of the pipe launcher to the second predetermined position, the pipe pointed towards the drilling platform, the box end higher in elevation than the pin end;

at least one hydraulic cylinder for tilting the top drive motor about a substantially horizontal axis until the quill is pointed toward the box end of said pipe and substantially aligned coaxially with the longitudinal axis of said pipe, the at least one hydraulic cylinder having first and second ends the first end operatively connected to the top drive frame, the second end operatively attached to the ton drive motor, whereby operation of the at least one hydraulic cylinder results in the top drive motor rotating about the horizontal axis with respect to the top drive frame;

a buggy for pushing the joint of pipe along its longitudinal axis from the second predetermined position toward the top drive motor whereby the box end may be threadably engaged to the quill, the buggy adapted to travel along the ramp of the pine launcher, the buggy adapted to support the pin end of to pipe as the buggy pushes the pipe; and a pipe clamping assembly for grasping and pulling the joint of pipe along its longitudinal axis toward the top drive motor, the pipe clamping assembly comprising:

a sliding member having first and second ends, the first end slidably attached to the top drive motor, the sliding member capable of sliding along an axis substantially parallel to the longitudinal axis of the quill, and a pipe clamp subassembly operatively attached to the second end of the sliding member, the pipe clamp subassembly adapted to grasp the pipe after the sliding member has extended downward from the top drive motor until the pipe clamp subassembly is positioned below the quill, the pipe clamp subassembly adapted to clamp the joint of pipe and align it with the longitudinal axis of the quill, the sliding member further capable of retracting towards the top drive motor after the pipe clamp subassembly has clamped the pipe to thereby pull the clamped pipe towards the top drive motor for connection with the quill.

5. The system as set forth in claim 4 wherein the means for raising and lowering the top drive assembly to the first predetermined position comprises a draw works mechanism.

6. A top drive assembly for use in a drilling rig, comprising:

a top drive frame adapted for being raised and lowered in a drilling mast of the drilling rig, the drilling mast defining a substantially vertical drilling axis;

a top drive motor having a quill adapted for connection with a joint of pipe, the quill capable of rotation about a longitudinal axis that is substantially coaxially aligned with the drilling axis when the top drive motor is being operated in drilling operations, the top drive motor being pivotally attached to the top drive frame whereby the top drive motor is capable of tilting about a substantially horizontal axis;

means for tilting the top drive motor about the horizontal axis with respect to the top drive frame thereby tilting the longitudinal axis of the quill from the substantially vertical drilling axis; and means for gripping a joint of pipe, said gripping means operatively attached to the top drive motor, said gripping means capable of grasping a joint of pipe positioned beneath the top drive motor and pulling the joint of pipe toward the top drive motor for connection with the quill.

7. The top drive assembly as set forth in claim 6 wherein the top drive frame is adapted to be raised and lowered in the drilling mast by a draw works mechanism.

8. The top drive assembly as set forth in claim 6 wherein the quill further comprises pin threads for connection with a box end of the joint of pipe.

9. The top drive assembly as set forth in claim 6 wherein the means for tilting the top drive motor about the horizontal axis comprises at least one hydraulic cylinder having first and second ends, the first end operatively connected to the top drive frame, the second end operatively connected to the top drive motor, whereby operation of the hydraulic cylinder thereby results in the top drive motor rotating about the horizontal axis with respect to the top drive frame.

10. The top drive assembly as set forth in claim 6 wherein the means for grasping a joint of pipe is a pipe clamping assembly comprising:

a sliding member having first and second ends, the first end slidably attached to the top drive motor, the sliding member capable of sliding along an axis substantially parallel to the longitudinal axis of the quill; and a pipe clamp subassembly operatively attached to the second end of the sliding member, the pipe clamp subassembly adapted to grasp the pipe after the sliding member has extended downward from the top drive motor until the pipe clamp subassembly is positioned below the quill, the pipe clamp subassembly adapted to clamp the joint of pipe and align it wit the longitudinal axis of the quill, the sliding member further capable of retracting toward the top drive motor after the pipe clamp subassembly bas clamped the pipe to thereby pull the clamped pipe toward the top drive motor for connection with the quill.

11. The top drive assembly as set forth in claim 10 wherein the pipe clamp assembly comprises:

a pipe clamp frame;

a pipe clamp; and a pipe catnip actuator operatively connecting the pipe clamp to the pipe clamp frame, the pipe clamp actuator adapted to move the pipe clamp in clamping engagement against a joint of pipe.

* * * * *